United States Patent [19]

Naka et al.

[11] 4,389,219

[45] Jun. 21, 1983

[54] STABILIZED COAL-OIL MIXTURE

[75] Inventors: Akihiro Naka, Joyo; Shuichi Honjo, Kyoto, both of Japan

[73] Assignee: Dai-Ichi Kogyo Seiyaku Co., Ltd., Kyoto, Japan

[21] Appl. No.: 351,388

[22] Filed: Feb. 23, 1982

[30] Foreign Application Priority Data

Apr. 3, 1981 [JP] Japan ..... 56-50715

[51] Int. Cl.[3] ..... C10L 1/18

[52] U.S. Cl. ..... 44/51; 44/73; 44/77; 252/357; 564/60; 564/103; 564/443; 564/505

[58] Field of Search ..... 44/51, 73, 77; 252/357; 564/505, 443, 278

[56] References Cited

U.S. PATENT DOCUMENTS 4,251,229 2/1981 Naka et al. ..... 252/356

*Primary Examiner*—Charles F. Warren
*Assistant Examiner*—Margaret B. Medley
*Attorney, Agent, or Firm*—Millen & White

[57] ABSTRACT

Mixture of a fuel oil and pulverized coal are stabilized by the addition of a small amount of a polyether-type adduct having a molecular weight of from 6,000 to 600,000 between a lower alkylene oxide and a poly(-lower alkyleneimine) compound, or a derivative of said adduct.

17 Claims, No Drawings

STABILIZED COAL-OIL MIXTURE

BACKGROUND OF THE INVENTION

This invention relates to a stabilized fuel slurry composition comprising a fuel oil and pulverized coal.

Pulverized coal has certain disadvantages which limit the use thereof as fuel, such as difficulty in transportation and storage, low heat value, difficulty in combustion-control and the like. Mixtures of pulverized coal with fuel oils generally known as coal-oil mixture (hereinafter referred to as "COM") may eliminate these disadvantages and are valueable as fuel because their costs per unit heat value are cheaper than any fuel oil alone.

However, coal particles in a slurry produced by simply mixing pulverized coal into a fuel oil tend to sediment from the slurry upon storage so that the slurry loses its fluidity entirely.

A great number of additives were tested to stabilize and prevent the slurry from being separated into its component upon storage. The basic requirements for such additives include that they are relatively cheap and effective at a small concentration for a long period of time when added into COM.

The stabilizer used herein complies with these basic requirements.

DESCRIPTION OF THE INVENTION

According to the present invention, a fuel slurry composition is provided which comprises pulverized coal, a fuel oil and a small amount of, as a stabilizing agent, a polyether-type adduct of a molecular weight from 6,000 to 600,000 of a lower alkylene oxide with a compound selected from the group consisting of:

(a) a poly(lower alkyleneimine) having 7 to 200 nitrogen atoms;

(b) an adduct of a lower alkyleneimine having 7 to 200 nitrogen atoms with an active hydrogen compound selected from the group consisting of an alcohol, a phenol, an amine and a carboxylic acid; and (c) a reaction product of said compound (a) or (b) with a compound selected from the group consisting of an aldehyde, a ketone, an alkyl halide, an isocyanate, a thioisocyanate, a compound having active double bond, an epoxy compound, an epihalohydrine, a cyanamide, a guanidine, urea, a carboxylic acid, an acid anhydride and an acyl halide.

With the use of the above-mentioned stabilizing agent, the resulting COM exhibits an increased stability and fluidity more remarkably than was possible with known stabilizers and may be stored at ambient temperature or higher temperatures for a long period of time without sedimentation. Even if sedimentation occurred slightly, the stabilizer of the present invention effectively prevent coal particles from agglomerating into a mass and the mixture may be re-fluidized by gently stirring the COM. Of course, such stirring is not necessary during a short term storage e.g. up to 15 days. Thus, the present invention permits the economical and efficient transporation of COM by tankers or by pumping through pipe lines to the location of use but also the storage thereof in a tank for a long period of time. The stabilizing agent of this invention may exhibit a satisfactory result at much lower concentrations compared with known stabilizers thereby making COM more economical.

In practising the present invention, various types of coal may used regardless of the place of production, chemical constitution or moisture content and include anthracite, bituminous coal, subbituminous coal, lignite, cleaned coal of these types of coal and the like.

The term "cleaned coal" as used herein refers to those products obtained from mined coal by removing or decreasing its inorganic impurity contents such as ash and sulfur. Several processes are known for cleaning coal in this manner such as the heavy media separation process, the oil agglomeration process, the floatation process and other processes. Any process may be applied for preparing cleaned coal used in the present invention.

The oil agglomeration process, for example, may be carried out by adding an amount of oil to an aqueous slurry of pulverized coal particles or suspending oil-coated pulverized coal particles in water, and then stirring the slurry. Organic components in the coal are wetted selectively with oil to agglomerate into a mass, while inorganic impurities thereof remain in the aqueous phase. Separation of aqueous phase from the mixture gives cleaned coal having a greatly reduced inorganic impurity content. The process is generally carried out at a coal concentration from 10 to 65%. Examples of oils which may be used in the oil agglomeration process include petroleum crude oil and liquid fractions thereof such as kerosine, light oil, bunker A, bunker B, bunker C and the like. Other mineral oils such as residue from ethylene-cracking, shale oil, lubricant oil and cleaning oil as well as benzene, toluene, xylene and various animal and vegetable oils may be used. Heavy oils such as bunker C or tar residue oil are preferable for economical reason. The amount of oil needed for giving a satisfactory result is generally less than 20% by weight based on the weight of coal.

The floatation process may be carried out, as is well-known, by adding a very small amount of oil into a pulverized coal-water slurry and then vigorously stirring the slurry to form froth. Organic components of coal selectively adhere to oil films of the froth while inorganic impurities remain in the aqueous phase. Examples of oils which may be employed in the floatation process include terpene oil, tar, bunker A, bunker C, light oil and kerosine.

The above two processes may generally reduce the inorganic impurities by several tens percents of their original contents.

Uncleaned coil may be pulverized in any conventional process either by the dry process or by the wet process in oil using various types of mills. Coarse particles of cleaned coal may also be pulverized in a similar way. Fine particles of cleaned coal may be used as such for the preparation of COM according to the present invention. The wet process is generally preferable compared with the dry process for pulverizing the coal because it is safe and clean and may improve the stability of resultant COM. Excessive water present in the starting coal may be removed during or after the pulverization process. Preferable average particle size of pulverized coal is less than 200 microns, more preferably less than 100 microns from the combustibility standpoint. A still larger particle size may be permitted as far as the stability of COM is concerned.

The consistency of pulverized coal in the final COM preferably ranges from 20 to 70% by weight, more preferably from 30 to 60% by weight. Excessively high consistency results in a remakable increase in viscosity with a decrease in fluidity and lower consistencies are economically insignificant.

Any suitable type of fuel oils may be used for the preparation of COM. Examples thereof are petroleum crude oil and liquid fractions thereof such as kerosine, light oil, bunker A, bunker B, bunker C, residual oil from ethylene-cracking process, creosote oil, anthracene oil, various compound oils, various waste oils such as waste oils from gasoline stations (lubricants and cleaning oils), waste oils from ironworks (machine oils, cutting oils, cleaning oils and the like), waste oils from marines, waste oils from chemical plants and mixtures of these oils. Among them petroleum crude oil, bunker B and bunker C are preferable. In cases where two or more types of oils are to be mixed, they may be mixed either prior to or subsequent to the mixing step with pulverized coal.

The fuel slurry of the present invention may contain a minor amount of water originating either from the starting coal or externally added water. A large quantity of water should not be present in COM because it occupies an additional volume thereby increasing transportation and storage costs and causes a substantial amount of heat loss due to the evaporation latent heat. However, water may improve the stability of COM and cleanness of flue gas in terms of decrease in dust and $NO_x$ and, therefore, a water content of less than 15%, preferably less than 6% by weight may be tolerated.

The polyether-type adduct used as a stabilizing agent for COM in the present invention has a molecular weight from 6,000 to 600,000, preferably from 10,000 to 300,000 and nitrogen atoms from 7 to 200, preferably from 9 to 100 per mole.

The adduct may be prepared by reacting a lower alkylene oxide with the starting poly(lower alkyleneimine) (a), (b) or (c) as hereinbefore defined.

The above poly(lower alkyleneimine) (a) may be synthesized by polymerizing a lower alkyleneimine such as ethyleneimine or propyleneimine or by the ammonolysis or aminolysis of a lower dihaloalkane such as dichloroethane or bromoethane with ammonia or methylamine.

The starting poly(lower alkyleneimine) (b) may be synthesized by reacting a large excess of a lower alkyleneimine such as ethyleneimine or propyleneimine with a compound having at least one active hydrogen atom. Examples of compounds having at least one active hydrogen atom include an alcohol such as tallow alcohol, glycerol, diethylene glycol and the like, a phenol such as phenol, nonylphenol and the like, an amine such as diethylenetriamine, tallow alkylamine and the like, and a carboxylic acid such as coconut fatty acid and the like.

The above starting materials (a) and (b) may be reacted with various reagents to form the starting material (c). The reagents include an aldehyde such as glyoxal, thiodiacetaldehyde and the like, a ketone such as diethyl ketone, an alkyl halide such as ethyl chloride, an isocyanate or thioisocyanate such as tolylenediisocyanate, m-xylylenediisocyanate, hexamethylenediisocyanate and the like, a compound having active double bond, an epoxy compound such as diglycidyl bisphenol A, diglycidyl ethylene glycol, diglycidyl tetraoxyethylene glycol and the like, an epihalohydrine such as epichlorohydrine, a cyanamide, a guanidine, urea, a carboxylic acid such as lauric acid, an acid anhydride such as maleic anhydride, phthalic anhydride and the like, an acyl halide such as adipic dichloride, azelaic dibromide, oxalic dichloride, phthalic dibromide and the like.

The stabilizing agent used in the present invention may be prepared by reacting the above starting material (a), (b) or (c) with a lower alkylene oxide in the well-known manner. Examples of lower alkylene oxides include ethylene oxide, propylene oxide and butylene oxide. Block or random copolymerization of propylene oxide and ethylene oxide, for example, may be employed. Block polymerization may impart a surface activity to the resultant adduct and is preferable. The amount of alkylene oxide to be addition-polymerized with the starting material is adjusted so that the resulting adduct has an average molecular weight from 6,000 to 600,000, preferably from 10,000 to 300,000.

The stabilizing agent used in the present invention preferably contains 3 to 80% by weight, more preferably 10 to 50% by weight of oxyethylene chain based on the weight of the alkylene oxide adduct.

The stabilizing agent of the invention may be added to COM as such or as a solution in a solvent such as isopropanol, butyl cellosolve, petroleum solvent and the like. The stabilizing agent may be used, if desired, in conjunction with other additives such as anionic or nonionic surfactants. The mixing of the stabilizing agent with other components of COM may be carried out in any desired order with stirring using a conventional equipment.

The amount of stabilizing agent needed for achieving a satisfactory result varies depending upon the type and particle size of pulverized coal and the type of fuel oil and generally ranges from 0.01 to 5% by weight, preferably from 0.04 to 0.8% by weight based on the total weight of COM components.

The invention is further illustrated by the following example in which all parts and percents are by weight.

EXAMPLE

Using various stabilizing agents listed in Table 1, various COM compositions were prepared as shown in Table 2 and Table 3.

Assessment of stability of COM was carried out in the following manner.

1. Glass rod-penetration test

Into a cylindrical container made of stainless steel (5.5 cm inner diameter×20 cm height) having three ports with stopper means located at the bottom, 6 cm and 12 cm levels, respectively, was placed COM up to 18 cm level. A cover plate centrally defining a circular hole was placed on the top of the cylinder and a glass rod weighing 20 g having a diameter of 5 mm was inserted through the hole and allowed to penetrate the COM by its own weight. The lower end of the glass rod defines a plane perpendicular to its longitudinal axis. The length of time required for the glass rod to reach the bottom counting from its starting position at the surface of COM was counted. The length of this penetration time is directly proportional to the degree of sedimentation of coal particles and inversely proportional to the fludity of COM.

This test was carried out after standing COM for 30 days at 70° C.

2. Viscosity and concentration test

After the completion of the penetration test, the content of cylindrical container was divided into the upper portion above 12 cm level, the middle portion between 6 cm and 12 cm levels and the lower portion below 6 cm level by opening the respective ports successively. Then the viscosity and coal concentration of each portion were determined.

The results of these tests were shown in Table 2 and Table 3. As shown in these tables, the fuel slurry composition of the present invention remains stable and homogeneous for a long time as indicated by a penetration time from 1.0 to 4.5 seconds and also by a small difference in viscosity and coal concentration between layers upon standing at 70° C. for 30 days.

TABLE 1

List of stabilizing agents

| Stabilizing agent | | Starting material (number of nitrogen atoms) | M.W. PO, EO adduct | EO content (%) |
|---|---|---|---|---|
| A | (a) | polyethyleneimine (150) | $3.5 \times 10^5$ | 8 |
| B | | polyethyleneimine (200) | $5 \times 10^5$ | 65 |
| C | | polyethyleneimine (25) | $8 \times 10^3$ | 0 |
| D | | polyethyleneimine (65) | $4.3 \times 10^5$ | 100 |
| E | | polyethyleneimine (12) | $2 \times 10^4$ | 80 |
| F | | polyethyleneimine (30) | $7 \times 10^4$ | 5 |
| G | | polyethyleneimine (80) | $2.6 \times 10^5$ | 15 |
| H | | polyethyleneimine (15) | $1.2 \times 10^5$ | 45 |
| I | | polyethyleneimine (55) | $2.4 \times 10^5$ | 20 |
| J | | polyethyleneimine (20) | $1.5 \times 10^5$ | 35 |
| K | (b) | adduct of ethyleneimine + tallow alcohol (10) | $5 \times 10^4$ | 7 |
| L | | adduct of ethyleneimine + glycerol (37) | $2 \times 10^5$ | 45 |
| M | | adduct of ethyleneimine + ethylene glycol (95) | $2.5 \times 10^5$ | 30 |
| N | | adduct of ethyleneimine + diethylenetriamine (40) | $1.1 \times 10^5$ | 12 |
| O | | adduct of ethyleneimine + tallow alkylamine (20) | $3 \times 10^4$ | 20 |
| P | | adduct of ethyleneimine + coconut fatty acid (65) | $1.7 \times 10^5$ | 38 |
| Q | | adduct of ethyleneimine + phenol (15) | $2 \times 10^4$ | 25 |
| R | | adduct of ethyleneimine + nonylphenol (30) | $8 \times 10^4$ | 18 |
| S | (c) | reaction product of polyethyleneimine (1 mole) + $(C_2H_5)_2CO$ (1 mole) (15) | $4 \times 10^4$ | 7 |
| T | | reaction product of polyethyleneimine (1 mole) + $C_2H_5Cl$ (5 moles) (30) | $1.2 \times 10^5$ | 15 |
| U | | reaction product of polyethyleneimine (1 mole) + epichlorohydrin (5 moles) (55) | $1.8 \times 10^5$ | 42 |
| V | | reaction product of polyethyleneimine (1 mole) + lauric acid (10 moles) (90) | $2.4 \times 10^5$ | 28 |

PO: propylene oxide
EO: ethylene oxide

TABLE 2

COM with uncleaned coal

| Run No. | Coal-oil mixture: Stabilizing agent & content (%) | | Coal & content (%) | | Fuel oil & content (%) | | Water content (%) | Coal pulverization process |
|---|---|---|---|---|---|---|---|---|
| | The invention: | | | | | | | |
| 1 | A | 0.2 | Australia bituminous, | 50.0 | Middle East bunker C, | 47.8 | 2.0 | wet in oil |
| 2 | B | " | " | 48.0 | " | 46.8 | 5.0 | " |
| 3 | C | " | China bituminous, | 46.0 | " | 51.0 | 2.8 | dry |
| 4 | D | " | " | 53.0 | China heavy, | 46.0 | 0.8 | wet in oil |
| 5 | E | 0.1 | " | 48.0 | " | 50.3 | 1.6 | " |
| 6 | F | " | Australia bituminous, | 50.0 | Middle East bunker C, | 48.9 | 1.0 | " |
| 7 | G | 0.06 | " | 56.0 | bunker A, | 41.94 | 2.0 | dry |
| 8 | H | " | Australia lignite, | 35.0 | Indonesia heavy, | 60.94 | 4.0 | wet in oil |
| 9 | I | " | N. America subbituminous, | 42.0 | Alaska heavy, | 54.94 | 3.0 | " |
| 10 | J | 0.08 | " | 45.0 | Middle East bunker C, | 52.42 | 2.5 | " |
| 11 | K | 0.1 | S. Africa bituminous, | 48.0 | " | 50.7 | 1.2 | " |
| 12 | L | " | " | 50.0 | Indonesia heavy, | 48.9 | 1.0 | dry |
| 13 | M | " | Australia lignite, | 40.0 | " | 56.7 | 3.2 | " |
| 14 | N | 0.06 | " | 32.0 | Middle East bunker C, | 60.94 | 7.0 | wet in oil |
| 15 | O | " | China bituminous, | 48.0 | " | 48.94 | 3.0 | " |
| 16 | P | " | " | 53.0 | China heavy, | 45.44 | 1.5 | " |
| 17 | Q | " | N. America bituminous, | 40.0 | Alaska heavy, | 56.94 | 3.0 | " |
| 18 | R | 0.08 | Australia bituminous, | 55.0 | Crude petroleum, | 42.92 | 2.0 | " |
| 19 | S | 0.1 | " | 53.0 | bunker A, | 45.5 | 1.4 | " |
| 20 | T | 0.06 | " | 48.0 | Middle East bunker C, | 49.74 | 2.2 | dry |
| 21 | U | " | Vietnam anthracite, | 51.0 | " | 47.14 | 1.8 | wet in oil |
| 22 | V | " | Australia lignite, | 38.0 | Indonesia heavy, | 58.44 | 3.5 | " |
| | Control: | | | | | | | |
| 23 | None | — | Vietnam anthracite, | 50.0 | Middle East bunker C, | 48.0 | 2.0 | " |
| 24 | Na oleate | 1.0 | Australia bituminous, | 55.0 | Crude petroleum, | 42.5 | 2.5 | " |
| 25 | Ca palmitate | 2.0 | Australia lignite, | 40.0 | Indonesia heavy, | 51.0 | 7.0 | " |

Assessment of stability after standing at 70° C. for 30 days

| Run No. | Glass rod penetration time (second) | Viscosity at 70° C. (cp) Upper | Middle | Lower | Coal concentration (%) Upper | Middle | Lower |
|---|---|---|---|---|---|---|---|
| The invention | | | | | | | |
| 1 | 4.0 | 1500 | 1900 | 2400 | 46.8 | 51.0 | 52.4 |
| 2 | 3.5 | 1450 | 1800 | 2300 | 45.0 | 48.5 | 51.0 |
| 3 | 4.5 | 1100 | 1400 | 1650 | 43.0 | 46.5 | 48.0 |

TABLE 2-continued

COM with uncleaned coal

| | | | | | | | |
|---|---|---|---|---|---|---|---|
| 4 | 3.0 | 1600 | 1900 | 2150 | 50.2 | 54.0 | 56.0 |
| 5 | 2.5 | 1500 | 1650 | 1850 | 46.0 | 48.5 | 50.0 |
| 6 | 3.0 | 1650 | 1800 | 1950 | 48.0 | 50.0 | 52.0 |
| 7 | 1.0 | 1900 | 2000 | 2050 | 55.0 | 56.0 | 56.6 |
| 8 | 3.0 | 2150 | 2200 | 2200 | 34.6 | 35.2 | 35.5 |
| 9 | 1.6 | 1750 | 1800 | 1850 | 41.5 | 42.0 | 42.0 |
| 10 | 1.8 | 2400 | 2400 | 2450 | 44.4 | 45.0 | 45.2 |
| 11 | 2.0 | 1500 | 1650 | 1850 | 46.0 | 48.5 | 50.0 |
| 12 | 2.4 | 1700 | 1700 | 1800 | 49.5 | 50.0 | 50.5 |
| 13 | 3.0 | 2350 | 2400 | 2500 | 39.0 | 40.5 | 41.0 |
| 14 | 1.2 | 1600 | 1600 | 1650 | 32.0 | 32.0 | 32.5 |
| 15 | 1.5 | 1700 | 1750 | 1800 | 47.6 | 48.5 | 48.5 |
| 16 | 1.0 | 1900 | 1950 | 2000 | 52.5 | 53.0 | 53.5 |
| 17 | 2.0 | 1500 | 1500 | 1550 | 40.0 | 40.0 | 40.5 |
| 18 | 2.0 | 1900 | 2000 | 2050 | 54.5 | 55.5 | 56.0 |
| 19 | 1.0 | 1250 | 1300 | 1350 | 52.5 | 53.0 | 53.5 |
| 20 | 1.6 | 1700 | 1750 | 1800 | 47.0 | 48.5 | 48.5 |
| 21 | 1.2 | 1600 | 1650 | 1700 | 50.4 | 51.2 | 51.5 |
| 22 | 2.0 | 2250 | 2300 | 2300 | 37.6 | 38.0 | 38.0 |
| Control | | | | | | | |
| 23 | ∞ | 200 | >20000 | >20000 | 8.5 | 68.0 | 74.0 |
| 24 | ∞ | 400 | " | " | 20.2 | 69.0 | 75.5 |
| 25 | ∞ | 300 | " | " | 3.0 | 51.0 | 66.0 |

TABLE 3

COM with cleaned coal

| Run No. | Coal-oil mixture: Stabilizing agent & content (%) | | Coal & content (%) | | Fuel oil & content (%) | | Water content (%) | Coal cleaning: Coal pulverization process before cleaning | Cleaning process | Deashing rate (%) | Re-pulverization process after cleaning |
|---|---|---|---|---|---|---|---|---|---|---|---|
| | The invention: | | | | | | | | | | |
| 26 | E | 0.1 | Australia bituminous, | 50.0 | Middle East bunker C, | 46.9 | 3.0 | dry | OA | 50 | dry |
| 27 | G | 0.06 | Australia bituminous, | 56.0 | bunker A, | 39.74 | 4.2 | wet in water | float. | 35 | none |
| 28 | J | 0.08 | N. America subbituminous, | 45.0 | Middle East bunker C, | 51.24 | 3.7 | " | OA | 40 | wet in oil |
| 29 | L | 0.1 | S. Africa bituminous, | 50.0 | Indonesia heavy, | 47.9 | 2.0 | dry | OA | 45 | " |
| 30 | O | 0.06 | China bituminous, | 48.0 | Middle East bunker C, | 50.42 | 1.5 | wet in water | float. | 35 | none |
| 31 | U | 0.06 | Australia bituminous, | 45.0 | " | 40.92 | 14.0 | " | OA | 50 | wet in oil |
| 32 | V | 0.06 | Vietnam anthracite, | 51.0 | " | 47.14 | 1.8 | dry | OA | 45 | dry |
| | Control | | | | | | | | | | |
| 33 | None | — | Vietnam anthracite, | 50.0 | " | 49.0 | 5.0 | " | OA | 55 | wet in oil |
| 34 | Na oleate | 1.0 | Australia bituminous, | 50.0 | bunker A, | 45.8 | 3.2 | " | float. | 35 | none |
| 35 | Ca palmitate | 2.0 | China bituminous | 48.0 | Middle East bunker C, | 48.5 | 1.5 | wet in water | OA | 50 | dry |

| Run No. | Assessment of stability after standing at 70° C. for 30 days: Glass rod penetration time (second) | Viscosity at 70° C. (cp) Upper | Middle | Lower | Coal concentration (%) Upper | Middle | Lower |
|---|---|---|---|---|---|---|---|
| The invention | | | | | | | |
| 26 | 3.6 | 1850 | 2000 | 2150 | 48.3 | 50.1 | 51.4 |
| 27 | 1.6 | 2200 | 2300 | 2350 | 55.0 | 56.5 | 57.0 |
| 28 | 2.4 | 2050 | 2150 | 2200 | 44.8 | 45.2 | 45.8 |
| 29 | 2.3 | 1800 | 1900 | 1900 | 49.6 | 50.1 | 50.4 |
| 30 | 1.8 | 1850 | 1900 | 1950 | 47.5 | 48.0 | 48.6 |
| 31 | 2.2 | 2500 | 2550 | 2550 | 44.5 | 45.0 | 45.0 |
| 32 | 1.8 | 1600 | 1700 | 1750 | 50.5 | 51.2 | 51.4 |
| Control | | | | | | | |
| 33 | ∞ | 300 | >20000 | >20000 | 5.5 | 70.0 | 74.5 |
| 34 | ∞ | 200 | " | " | 8.0 | 69.0 | 73.0 |
| 35 | ∞ | 500 | " | " | 3.0 | 70.0 | 71.0 |

OA: oil agglomeration process
float.: floatation process

The above has been offered for illustrative purposes only, and it is not for the purpose of limiting the scope of this invention which is defined in the claims below.

We claim:

1. A coal-oil mixture composition comprising a fuel oil, 20 to 70% by weight of pulverized coal and an effective amount of, as a stabilizing agent, a polyether-type adduct of a molecular weight from 6,000 to 600,000 of a lower alkylene oxide with a starting compound selected from the group consisting of:

(a) a poly(lower alkyleneimine) having 7 to 200 nitrogen atoms;

(b) an adduct of a lower alkyleneimine having 7 to 200 nitrogen atoms with a compound having at least one active hydrogen atom selected from the group consisting of an alcohol, a phenol, an amine and a carboxylic acid; and (c) a reaction product of said compound (a) or (b) with a compound selected from the group consisting of an aldehyde, a ketone, an alkyl halide, an isocyanate, a thiocyanate, a compound having active double bond, an epoxy compound, an epihalohydrin, a cyanamide, a guanidine, urea, a carboxylic acid, an acid anhydride, and an acyl halide.

2. The composition of claim 1, wherein said adduct has a molecular weight from 10,000 to 300,000.

3. The composition of claim 2, wherein said starting compound contains from 9 to 100 nitrogen atoms.

4. The composition of claim 1, wherein said starting compound contains a polyethyleneimino or polypropyleneimino chain.

5. The composition of claim 1, wherein said alcohol is tallow alcohol, glycerol or diethylene glycol.

6. The composition of claim 1, wherein said phenol is phenol or nonylphenol.

7. The composition of claim 1, wherein said amine is diethylenetriamine or tallow alkylamine.

8. The composition of claim 1, wherein said carboxylic acid having at least one active hydrogen atom is coconut fatty acid.

9. The composition of claim 1, wherein said ketone is diethyl ketone.

10. The composition of claim 1, wherein said alkyl halide is ethyl chloride.

11. The composition of claim 1, wherein said epihalohydrine is epichlorohydrine.

12. The composition of claim 1, wherein said starting compound is polyethyleneimine laurate.

13. The composition of claim 1, wherein said lower alkylene oxide is ethylene oxide, propylene oxide or butylene oxide.

14. The composition of claim 1, wherein said polyether-type adduct contains a ramdom or blocked ethylene oxide/propylene oxide chain, the content of ethylene oxide being from 3 to 80% by weight, preferably 10 to 50% by weight based on the weight of said polyether-type adduct.

15. The composition of claim 1, wherein said coal is cleaned coal.

16. The composition of claim 15, wherein said cleaned coal is prepared by the oil agglomeration process.

17. The composition of claim 15, wherein said cleaned coal is prepared by the floatation process.

* * * * *